US006416419B1

(12) United States Patent
Foresi

(10) Patent No.: US 6,416,419 B1
(45) Date of Patent: Jul. 9, 2002

(54) GOLF SWING TRAINER AND EXERCISER

(76) Inventor: Tony Foresi, 9717 Manor, Allen Park, MI (US) 48101

( * ) Notice: Subject to any disclaimer, the term of this patent is extended or adjusted under 35 U.S.C. 154(b) by 0 days.

(21) Appl. No.: 09/483,803

(22) Filed: Jan. 15, 2000

(51) Int. Cl.[7] ..... A63B 69/36
(52) U.S. Cl. ..... 473/227
(58) Field of Search ..... 473/201, 203, 473/204, 219, 223, 226, 228, 231, 232, 242, 256, 266, 282, 288, 289, 290, 300, 301

(56) References Cited

U.S. PATENT DOCUMENTS

| | | | | | |
|---|---|---|---|---|---|
| 1,990,281 | A | * | 2/1935 | Grelle | 473/232 |
| 2,843,384 | A | * | 7/1958 | Schmidt | 473/208 |
| 3,341,202 | A | * | 9/1967 | Stars | 473/282 |
| 4,145,054 | A | | 3/1979 | Stewart | 273/186 A |
| 4,595,204 | A | | 6/1986 | Patterson | 273/186 A |
| 4,754,978 | A | * | 7/1988 | Dworacek | 473/282 |
| 4,982,963 | A | * | 1/1991 | Fazzio | 473/256 |
| D316,888 | S | | 5/1991 | Foresi | D21/234 |
| 5,150,901 | A | | 9/1992 | Stawicki | 273/186.2 |
| 5,303,926 | A | | 4/1994 | Owens et al. | 273/186.1 |
| D352,985 | S | | 11/1994 | Eno | D21/234 |
| 5,520,392 | A | * | 5/1996 | Foresi et al. | 473/227 |
| D411,277 | S | | 6/1999 | Burkholder | D21/791 |
| 5,997,408 | A | * | 12/1999 | Bankhead | 473/227 |

* cited by examiner

*Primary Examiner*—Mark S. Graham
*Assistant Examiner*—Raeann Gorden
(74) *Attorney, Agent, or Firm*—Gifford, Krass, Groh, Sprinkle, Anderson & Citkowski, PC

(57) ABSTRACT

A golf-swing training apparatus is effective but compact enough to be used indoors. The apparatus includes a rigid shaft having a proximal end, a distal end, and a length substantially shorter that a conventional golf club. A weight is connected to the distal end of the shaft, and a grip surrounds the proximal end of the shaft. A bent member is included having first and second ends, the first end being permanently attached to the shaft at a point distally proximate to the grip, and the second extending rearwardly beyond the proximal end of the shaft and over the hands of the golfer when gripping the grip, such that no portion of the member contacts any portion of the golfer during a properly executed swing of the apparatus. The weight is preferably shaped like a golf-club head, such as the head of a driver. The grip also features an undulating outer surface, causing the user to assume an interlocking grip. In addition, the shaft preferably includes a bend between the distal end and the first end of the member where it attaches to the shaft to better simulate a true golf swing. In terms of manufacture, the shaft is preferably molded around a rigid element. For example, the shaft may be a thermoset polymeric material, and the rigid element a metal rod or wire. The grip is molded around the shaft, preferably using the same mold to form the shaft around the rigid element. In the preferred embodiment, the bent member is integrally attached to the shaft, and are molded around an integrally formed rigid element, with the grip being molded around the shaft using a common mold.

17 Claims, 1 Drawing Sheet

GOLF SWING TRAINER AND EXERCISER

FIELD OF THE INVENTION

The present invention relates generally to golf training devices and, in particular, to an economic and compact device that may be used both for golf swing training and exercise purposes.

BACKGROUND OF THE INVENTION

A wide variety of training devices are available to the golf enthusiast. One example is the device disclosed in U.S. Pat. No. 4,145,054, which comprises a rod attached to a golf club shaft which contacts the forearms the golfer during an improperly executed swing, thus advising of the error.

U.S. Pat. No. 4,595,204 discloses an elongated extension removably attached to the handle of the club. As the golfer performs a backstroke, forward stroke and follow-through simulating the striking of a ball, the extension indicates if the stroke is "correct." U.S. Pat. No. 5,150,901 includes a harness assembly attachable to the upper portion of a person's body and an elongated tubular golf swing guiding member coupled to the harness and attached to the handle of the club, which permits a golfer to achieve a proper swing by avoiding undesired bending of the front elbow. A multi-use golf training device is described in U.S. Pat. No. 5,303,926, which includes a weighted base and an upstanding flute guidepost with a positioning bar. By setting the positioning bar in one of a plurality of positions relative to the user, proper body positions and swing motions can be reinforced, thus improving a user's stance and swing during actual play.

Devices also exist which are weighted, thereby providing both a swing training and exercise capability. Devices of this type are described in design Patent Nos. D352,985 and D411,277, as well as in my own design Patent No. D316, 888. One problem with certain swing-training devices and exercise devices, is that the apparatus removably couples to a standard golf club. Although this may seem to be an efficient approach, the coupling mechanism is often complicated, including metal parts, thereby raising costs. For example, in the '054 patent to Stewart referenced above, a rod is clamped onto a standard golf club shaft which contacts the forearms of the golfer during a properly executed swing, thus advising the golfer of poor form. The golf swing training aid of D352,985 to Eno includes a bar with a weighted end and a clamp end which is presumably configured to attach to a standard golf club. Again, the clamp appears to be somewhat sophisticated, and may lead to manufacturing complications.

The need remains, therefore, for a combined golf swing trainer and exercise device, which includes both a weighted end and a mechanism for ensuring a properly executed golf swing. Although a standard length club may be used, such a device could be made more compact, thereby allowing training and exercise indoors. In addition, to keep costs low, manufacturing issues should be addressed to avoid complex assembly procedures, both for the supplier and user.

SUMMARY OF THE INVENTION

The subject invention resides in a golf-swing training apparatus which is efficient and economical, yet compact enough to be used indoors. The device includes a rigid shaft having a proximal end, a distal end, and a length substantially shorter that a conventional golf club. A weight is connected to the distal end of the shaft, and a grip surrounds the proximal end of the shaft. A bent member is included having first and second ends, the first end being permanently attached to the shaft at a point distally proximate to the grip, and the second extending rearwardly beyond the distal end of the shaft and over the hands of the golfer when gripping the grip, such that no portion of the member contacts any portion of the golfer during a properly executed swing of the apparatus.

In the preferred embodiment, the weight is shaped like a golf-club head, such as the head of a driver. The grip also features an undulating outer surface, causing the user to assume an interlocking grip. In addition, the shaft preferably includes a bend between the distal end and the first end of the member where it attaches to the shaft to better simulate a true golf swing.

In terms of manufacture, the shaft is preferably molded around a rigid element. For example, the shaft may be a thermoset polymeric material, and the rigid element a metal rod or wire. The grip is molded around the shaft, preferably using the same mold to form the shaft around the rigid element. In the preferred embodiment, the bent member is integrally attached to the shaft, and are molded around an integrally formed rigid element, with the grip being molded around the shaft using a common mold.

DETAILED DESCRIPTION OF THE INVENTION

Figure 1:
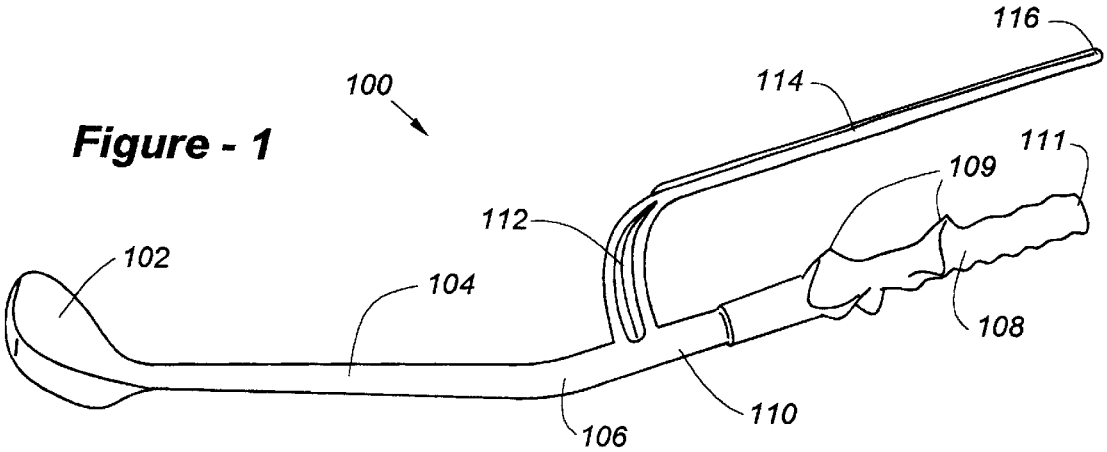
FIG. 1 is a drawing which shows a combined golf swing trainer and exerciser according to a preferred embodiment of the invention.

This invention resides in a combined golf swing trainer and exerciser, which is both compact and easy to manufacture. The preferred embodiment of the invention is depicted generally at 100 in FIG. 1. The device has a distal end with a weight, preferably shaped as a standard club head such as a driver 102, and a proximal end 111. A shaft 104 connects the weight at the distal end to the remainder of the device, preferably including a bend 106 approximately midway, changing the direction of the shaft at 110 to a proximal portion including a grip 108. Preferably, the grip 108 includes shaped undulations 109 which force a user to assume a preferred interlocking grip during use.

Integrally connected to the shaft is a bent member 112 having a first end connected to the shaft portion 110, and a proximal end 116 which extends somewhat closer to the user than the proximal end 111 of the shaft proper. The bent member includes a bar portion 114 which is preferably substantially parallel to the shaft portion 110 , and which intentionally interferes with the forearms of the golfer during a swing to remind the golfer that he or she has departed from an ideal form. The device is useful for all phases of a swing, including back swing, down swing and follow-through.

As shown, the shaft 104 may be said to have a top edge 105, which is the side or edge of the shaft 104, that is directed away from the torso of the golfer when the golfer is properly gripping the undulated grip 108. Also as shown, the bent member 112 preferably extends from and over this top edge 105 of the shaft 104.

Figure 2:
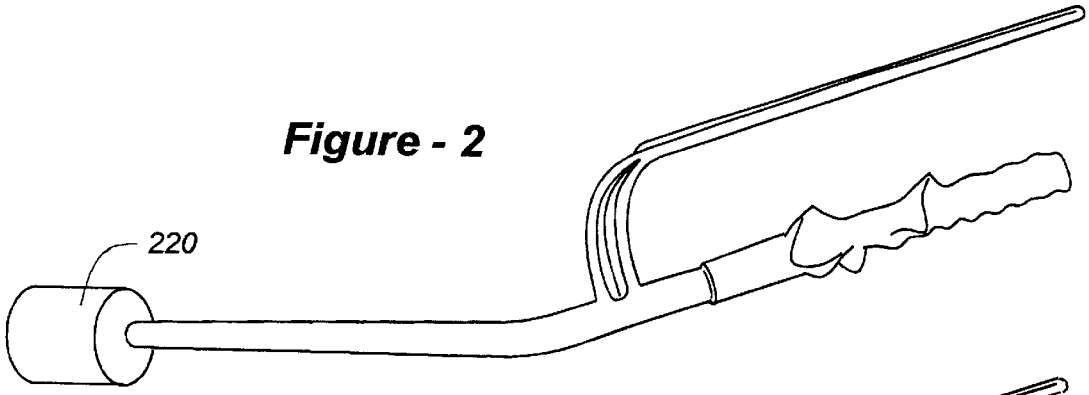
FIG. 2 is a drawing of an alternative embodiment of the invention, wherein a weight not shaped like a golf club head is instead used on the distal end of the device.
Figure 3:
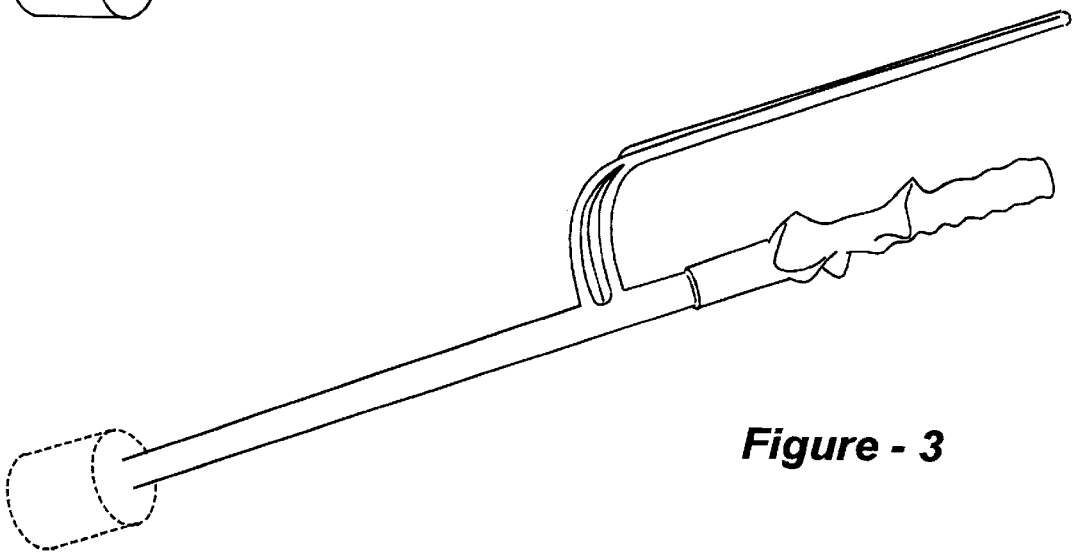
FIG. 3 illustrates a further alternative embodiment of the invention, wherein the shaft is shorter than a standard golf club, but straight as opposed to bent, regardless of the type of weight used.

FIG. 2 illustrates an alternative embodiment of the invention wherein the club head shaped end 102 of FIG. 1 is replaced with a simpler weight 220, as shown in my U.S. Pat. No. D316,888. Since the overall length of the device is substantially shorter than a conventional golf club, there is actually no need other than aesthetics to provide the weight in a golf club head shape. Nor is it necessary to the invention that the shaft be bent at 106 between portions 104 and 110 . Although a bend is a preferred configuration, the shaft may be straight, as shown in FIG. 3, regardless of the type of weight used at the distal end.

The device described herein may be manufactured in a number of ways though, in the preferred embodiment, an integral molding process is used to save on costs. As part of this process, a mold is produced having a cavity which conforms to the desired outer dimensions of the device overall. A weight used to form the weighted distal end of the device is placed into the mold, and this is connected to a rigid form such as a metal rod, used to establish rigidity for both the shaft and bent member portions of the device. These internal components are sized to be somewhat less than the other dimensions of the device overall, so that when mold material such as a thermoset polymer plastic is introduced into the mold, these internal components are completely covered.

To further save on manufacturing costs, the same mold is used to form the grip portion of the device. An insert is used in the mold for the first injection of thermoplastic material, which forms a hard surface around the end shaft and bent member, but an insert is placed in the mold in the area where the grip will be formed. Prior to the first material completely setting, the insert is removed, and a second injection of a softer material is introduced into the void, thereby forming the grip around the hard plastic covering the proximal end of the shaft 10. Particularly if the harder material has not yet set, the grip portion will adhere and form a strong, permanent bond.

I claim:

1. Golf-swing training apparatus, comprising:

a rigid shaft having a proximal end, a distal end, a top edge, and a length substantially shorter than a conventional golf club;

a weight connected to the distal end of the shaft;

a grip surrounding the proximal end of the shaft, the grip having an undulating surface configured to encourage a golfer to hold the grip in a predetermined orientation such that the top edge of the shaft is directed away from the torso of the golfer; and a bent member having first and second ends, the first end of the member being permanently attached to the shaft at a point distally proximate to the grip, the second end of the member extending rearwardly beyond the proximal end of the shaft and extending over the top edge of the shaft and the hands of the golfer when gripping the grip, such that no portion of the member contacts any portion of the golfer during a properly executed swing of the apparatus;

wherein the shaft includes a bend between the distal end and the first end of the member where it attaches to the shaft.

2. The apparatus of claim 1, wherein the weight is shaped like a golf-club head.

3. The apparatus of claim 2, wherein the golf-club head shaped weight is shaped as a head of a driver.

4. The apparatus of claim 1, wherein the undulating outer surface of the grip causes the user to assume an interlocking grip.

5. A golf-swing training apparatus, comprising:

a rigid shaft having a proximal end, a distal end, and a length substantially shorter than a conventional golf club;

a weight connected to the distal end of the shaft;

a grip surrounding the proximal end of the shaft; and a bent member having first and second ends, the first end of the member being permanently attached to the shaft at a point distally proximate to the grip, the second end of the member extending rearwardly beyond the proximal end of the shaft and over the hands of the golfer when gripping the grip, such that no portion of the member contacts any portion of the golfer during a properly executed swing of the apparatus;

wherein the shaft includes a bend between the distal end and the first end of the member where it attaches to the shaft.

6. The apparatus of claim 1, wherein the shaft is molded around a rigid element.

7. The apparatus of claim 6, wherein the shaft is a thermoset polymer and the rigid element is a metal rod.

8. The apparatus of claim 6, wherein the grip is molded around the proximal end of the shaft.

9. The apparatus of claim 5, wherein the bent member is integrally attached to the shaft.

10. The apparatus of claim 10, wherein the shaft and bent member are molded around a rigid element.

11. The apparatus of claim 11, wherein the shaft and bent member are composed of a thermoset polymer, and the rigid element is a metal rod.

12. The apparatus of claim 10, wherein the grip is molded around the proximal end of the shaft.

13. A golf-swing training apparatus, comprising:

a rigid shaft having a proximal end, a distal end, and a length substantially shorter than a conventional golf club;

a weight connected to the distal end of the shaft, the weight being shaped like a golf-club head with a hitting surface, the hitting surface generally defining a plane that is generally perpendicular to a golfer properly holding the apparatus;

a grip surrounding the proximal end of the shaft; and a bent member having first and second ends and lying generally in the perpendicular plane, the first end of the member being permanently attached to the shaft at a point distally proximate to the grip, the second end of the member extending rearwardly beyond the proximal end of the shaft and over the hands of the golfer when gripping the grip, such that no portion of the member contacts any portion of the golfer during a properly executed swing of the apparatus;

wherein the shaft includes a bend between the distal end and the first end of the member where it attaches to the shaft.

14. The apparatus of claim 16, wherein the grip has an undulating outer surface causing the user to assume an interlocking grip.

15. The apparatus of claim 16, wherein the shaft is molded around a rigid element.

16. The apparatus of claim 19, wherein the shaft is a thermoset polymer and the rigid element is a metal rod.

17. The apparatus of claim 19, wherein the grip is molded around the proximal end of the shaft.

* * * * *

UNITED STATES PATENT AND TRADEMARK OFFICE

CERTIFICATE OF CORRECTION

PATENT NO. : 6,416,419 B1
DATED : July 9, 2002
INVENTOR(S) : Tony Foresi

It is certified that error appears in the above-identified patent and that said Letters Patent is hereby corrected as shown below:

Column 3,
Line 35, replace “10” with -- 110 --.

Column 4,
Line 28, replace “claim 10” with -- claim 9 --.
Line 30, replace “claim 11” with -- claim 10 --.
Line 33, replace “claim 10” with -- claim 9 --.
Lines 58 and 60, replace “claim 16” with -- claim 13 --.
Lines 62 and 64, replace “claim 19” with -- claim 15 --.

Signed and Sealed this

Twenty-ninth Day of April, 2003

JAMES E. ROGAN
*Director of the United States Patent and Trademark Office*